United States Patent [19]

Kitaguchi et al.

[11] Patent Number: 4,670,373

[45] Date of Patent: Jun. 2, 1987

[54] ACID PRECURSOR

[75] Inventors: Hiroshi Kitaguchi; Masatoshi Kato, both of Kanagawa, Japan

[73] Assignee: Fuji Photo Film Co., Ltd., Kanagawa, Japan

[21] Appl. No.: 672,643

[22] Filed: Nov. 19, 1984

[30] Foreign Application Priority Data

Nov. 17, 1983 [JP] Japan ..... 58-216928

[51] Int. Cl.[4] ..... G03C 1/06

[52] U.S. Cl. ..... 430/353; 430/617; 430/619; 430/620

[58] Field of Search ..... 430/617, 203, 619, 620, 430/353

[56] References Cited

U.S. PATENT DOCUMENTS 3,220,846 11/1965 Tinker et al. ..... 430/179

4,499,180 2/1985 Hirai et al. ..... 430/203

*Primary Examiner*—Won H. Louie

*Attorney, Agent, or Firm*—Sughrue, Mion, Zinn, Macpeak, and Seas

[57] ABSTRACT

An organic acid precursor having a structural moiety of the following formula (I)

bonded to a carbon atom. This acid precursor is useful as a development stopping agent in a photographic heat-developable process.

10 Claims, No Drawings

ACID PRECURSOR

FIELD OF THE INVENTION

This invention relates to a novel acid precursor. The term "acid precursor", as used herein, denotes a compound which when heated, decomposes and releases an acid component.

BACKGROUND OF THE INVENTION

Frequently, bases are used in heat-developable photographic materials in order to promote development by heat. However, it is possible for development to occur beyond a level at which even if development time is further prolonged sensitivity does not come to increase though fog continues to increase owing to subtle variations in conditions such as temperature or time, resulting in a reduction in the image quality. In order to avoid this phenomenon in the diffusion transfer process, it has been proposed to use compounds which react with alkalies to release development stopping agents as described in U.S. Pat. No. 4,009,029, and acid polymers for neutralization as disclosed in *Research Disclosure,* Vol. 123, page 22 and Vol. 180, page 18030 and British Pat. No. 2,082,787A. In heat developable photographic materials, however, the former do not effectively stop development, and the latter cause a reduction in the density of the final image because the bases are rapidly neutralized.

The most effective development-stopping means conceivable is to perform development in the presence of a compound which releases an acid when even if development time is further prolonged sensitivity does not come to increase though fog continues to increase to neutralize the base which promotes development, thus stopping development. Very few compounds are known, however, which release acids when heated. For example, Japanese Patent Applications (OPI) Nos. 58642/74 and 57452/75 (corresponding to British Pat. No. 1,477,835) (the term "OPI", as used herein, refers to a "published, unexamined Japanese Patent Application") describe acid components which at a temperature of at least 60° C. are dissolved, or release volatile acids. Since, the compounds disclosed in these patent applications neutralize the bases before heat development is started, development is inhibited and the density of the final images is reduced.

SUMMARY OF THE INVENTION

It is an object of this invention to provide a novel compound which has the effect of stopping development without reducing the density of an image when even if development time is further prolonged sensitivity does not come to increase though fog continues to increase (at normal development time).

More specifically, this object is to provide a novel acid precursor which is very stable at ordinary temperatures, and when it is heated above a certain temperature and the development proceeds till the conditions under which even if development time is further prolonged, sensitivity does not come to increase though fog continues to increase, releases an acid to neutralize the base and stop the development.

Another object of this invention is to provide a heat developable photographic material which can give an image having a high S/N ratio and a high density.

These and other objects of the present invention are achieved by an organic acid precursor having a structural moiety of the following formula (I) bonded to a carbon atom.

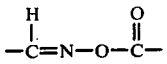

(I)

DETAILED DESCRIPTION OF THE INVENTION

Preferred acid precursors of this invention are represented by the following general formula (A).

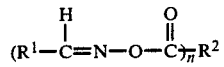

General formula (A):

In the above formula, $R^1$ represents a substituent selected from the group consisting of alkyl groups, substituted alkyl groups, cycloalkyl groups, aralkyl groups, alkenyl groups, aryl groups, substituted aryl groups and heterocyclic groups. $R^2$ represents an alkyl group, a substituted alkyl group, a cycloalkyl group, an aralkyl group, an aryl group, a substituted aryl group or a heterocyclic group, or a mono-, di- or tri-valent group selected from groups formed by combining the foregoing substituents. n is an integer of 1, 2 or 3.

In $R^1$ and $R^2$, preferred alkyl groups are straight chain or branched chain alkyl groups having 1 to 18 carbon atoms. Specific examples include ethyl, n-propyl, n-butyl, n-hexyl, n-heptyl, 2-ethylhexyl, n-decyl and n-dodecyl groups, Substituents on the substituted alkyl groups include, for example, halogen atoms, alkoxy groups, a cyano group, a substituted or unsubstituted carbamoyl group, a hydroxyl group and a carboxyl group.

In $R^1$ and $R^2$, preferred cycloalkyl groups are 5- or 6-membered cycloalkyl groups having 5 to 10 carbon atoms. More preferred examples are cyclopentyl and cyclohexyl groups. Examples of aralkyl groups are benzyl and $\beta$-phenethyl groups. Examples of the alkenyl groups are vinyl, allyl, crotyl and substituted or unsubstituted styryl groups.

In $R^1$ and $R^2$, preferred aryl groups are aryl groups having 6 to 18 carbon atoms. More preferred examples are phenyl, naphthyl and anthryl groups. The substituents on the substituted aryl groups include, for example, substituted or unsubstituted alkyl groups, substituted or unsubstituted alkoxy groups, substituted or unsubstituted aryl groups, halogen atoms, disubstituted amino groups substituted by alkyl or aryl groups, acylamino groups, a sulfonylamino group, a cyano group, a nitro group, alkyl- or aryl-thio groups, alkyl- or aryl-sulfonyl groups, an oxycarbonyl group, a carbonyloxy group, a substituted or unsubstituted carbamoyl group, and a substituted or unsubstituted sulfamoyl group.

In $R^1$ and $R^2$, examples of the heterocyclic group include pyridyl, furyl, thienyl, pyrrole and indolyl groups. These heterocyclic groups may be substituted with the above-described substituents of the substituted aryl groups.

Of the foregoing, examples of $R^1$ and $R^2$ aryl, substituted aryl and heterocyclic groups are preferred, and phenyl, substituted phenyl, naphthyl and substituted naphthyl groups are particularly preferred.

When heated, the acid precursor of this invention releases a carboxylic acid derivative in accordance with the following reaction.

$$(R^1-CH=N-\overset{O}{\overset{\|}{C}}O)_n R^2 \xrightarrow{\Delta} nR^1-C\equiv N + R^2(COOH)_n$$

It is known that when an aldoxime derivative (B) is heated with an acid anhydride ($Ac_2O$), the corresponding nitrile (C) is formed.

$$R^1-CH=NOH \xrightarrow[\Delta]{Ac_2O} R^1-C\equiv N$$

(B) (C)

It has now been found for the first time that the compound of general formula (A) which is an intermediate of this reaction can be easily isolated, and it acts as an effective acid precursor which is stable at room temperature and when heated, releases and acid. The temperature required for acid release is about 80° C. to 180° C., preferably 100° C. to 150° C. The rate of the reaction can be adjusted to more than 100 times by varying $R^1$ and $R^2$.

Specific examples of the acid precursor of this invention are shown below. The invention, however, is not to be construed as being limited to these specific examples.

(1)

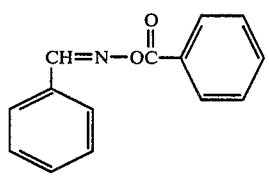

(2)

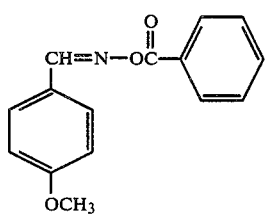

(3)

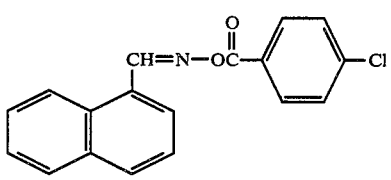

(4)

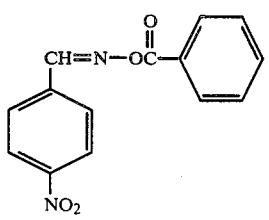

-continued (5)

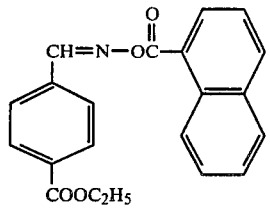

(6)

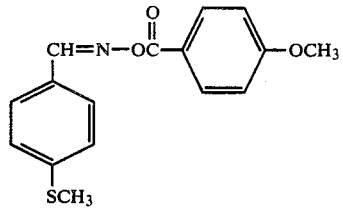

(7)

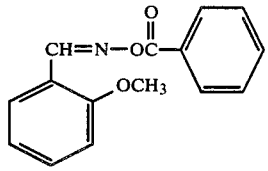

(8)

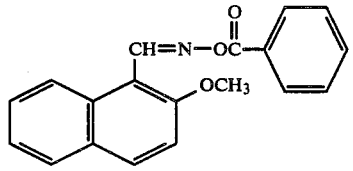

(9)

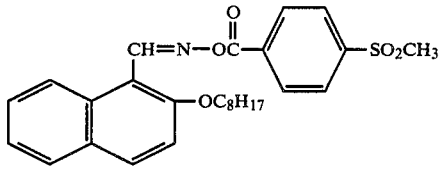

(10)

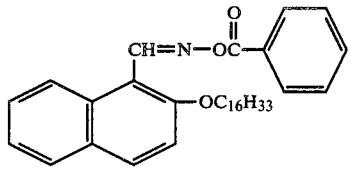

(11)

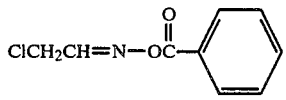

(12)

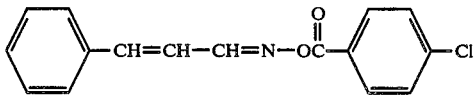

(14)

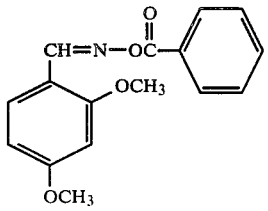

-continued
(15)
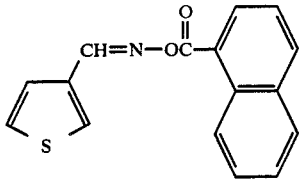
(16)
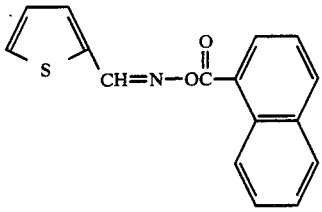
(17)
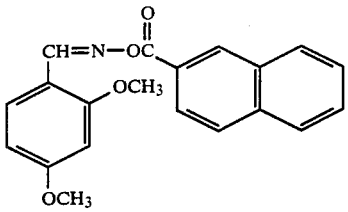
(18)
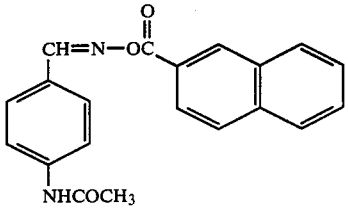
(19)
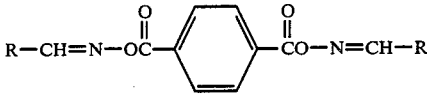
wherein R = 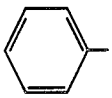
Compound (19) in which
(20)
R = 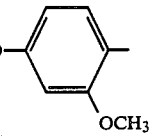
Compound (19) in which
(21)
R = 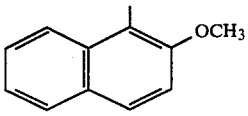
-continued
(22)
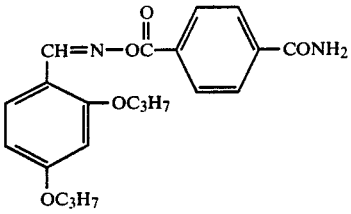
(23)
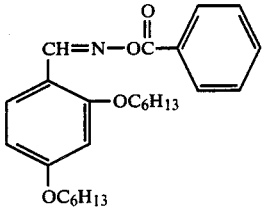
(24)
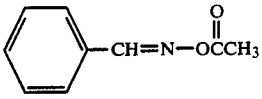
(25)
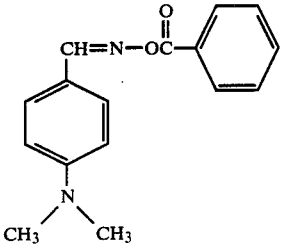
(26)
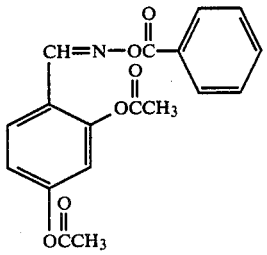
(28)
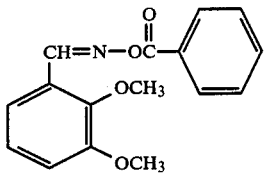
(29)
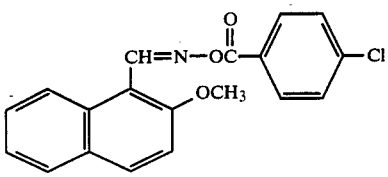

-continued
(30)
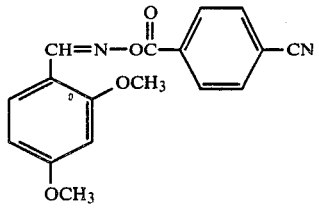
(31)
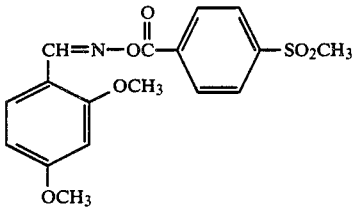
(32)
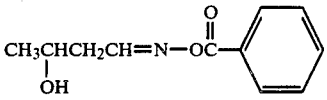
(33)
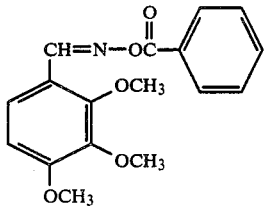
(34)
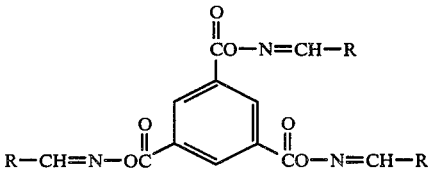
wherein R = 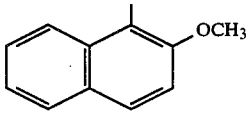
Compound (34) in which
(35)
R = 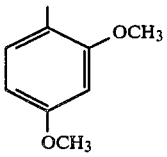
(36)
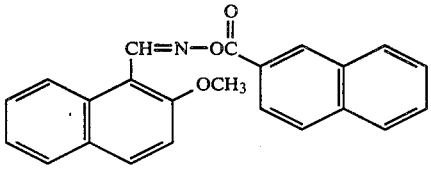
-continued
(37)
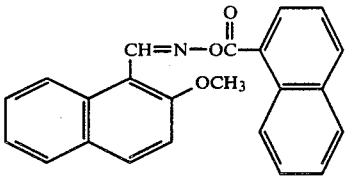
(38)
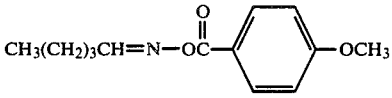
(39)
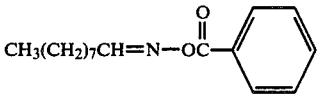
(40)
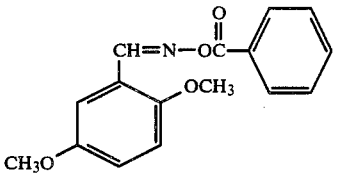
(41)
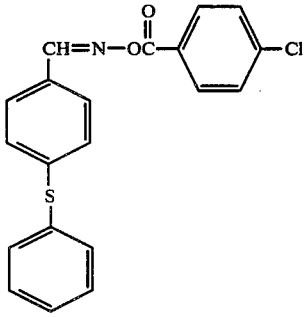
(42)
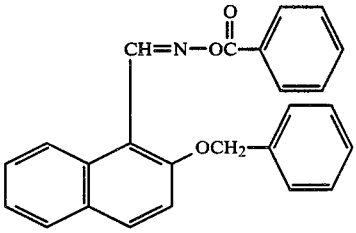
(43)
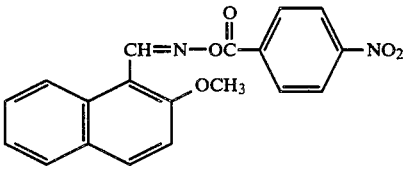
(44)
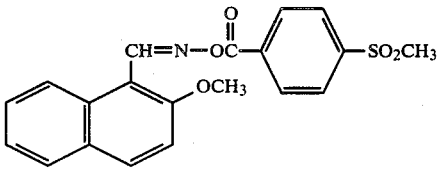

-continued
(45)
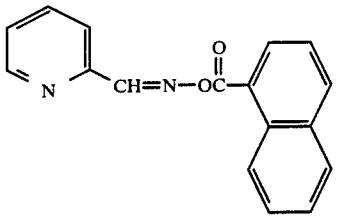
(46)
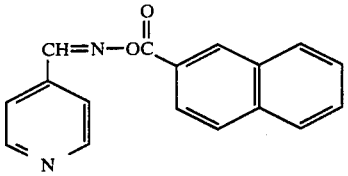
(47)
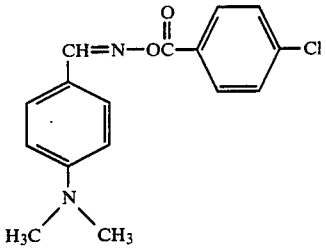
(48)
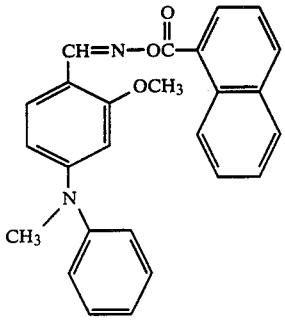
(49)
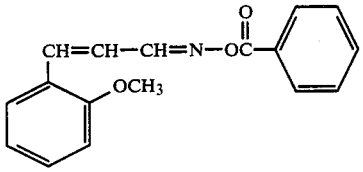
(50)
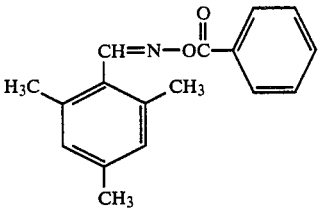
(51)
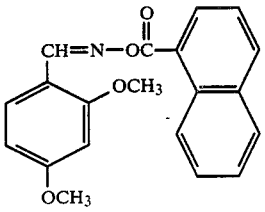
-continued
(52)
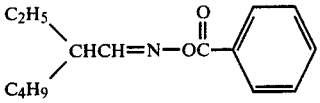
(53)
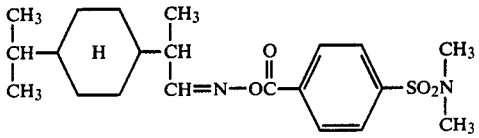
(54)
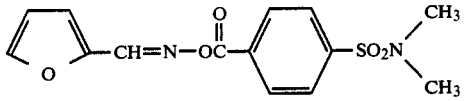
(55)
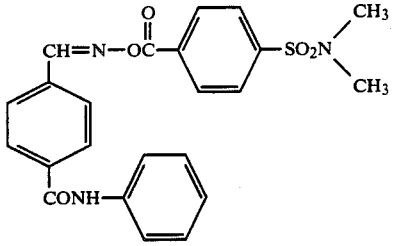
(56)
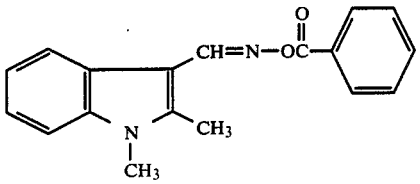
(57)
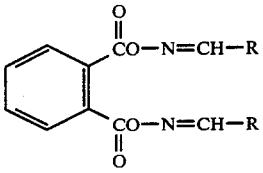
wherein
R = 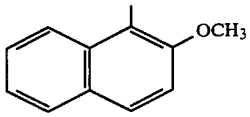
Compound (57) in which
(58)
R = 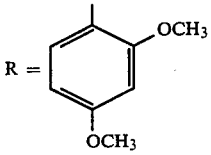
(59)
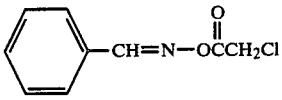
Methods of synthesizing the acid precursor of this invention are as follows.

The acid precursor of this invention can be synthesized by reacting an aldoxime derivative (D) with an acid halide ($R^2COX$) or an acid anhydride $(R^2CO)_2O$ in the presence of a base.

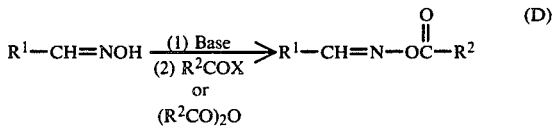

(D)

(wherein X represents a halogen atom)

Bases that can be used for this reaction include organic bases such as pyridine, dimethylaminopyridine and triethylamine, metal hydrides such as sodium hydride, and metal alcoholates such as sodium methylate. The simplest procedure which gives a high yield is to prepare a sodium salt of (D) using sodium hydride, and to react it with an acid chloride at a low temperature. Examples of syntheses are given below.

SYNTHESIS EXAMPLE 1

Synthesis of acid precursor (1):

With stirring, 8 g (0.167 mole) of 50% oily sodium hydride was added to 400 ml of an acetonitrile solution of 20 g (0.167 mole) of benzaldoxime. After the evolution of hydrogen gas ceased, the solution was cooled to 10° C., and while maintaining this temperature, 23.9 g (0.167 mole) of benzoyl chloride was added dropwise. The mixture was stirred at room temperature for 1 hour. The reaction mixture was added to 1 liter of water. The precipitated crystals were collected by filtration. The crude crystals were recrystallized from a mixture of n-hexane and ethyl acetate (3/1) to give 27.3 g (0.12 mole) of acid precursor (1) having a melting point of 100.5° C. to 101° C. Yield 73%.

SYNTHESIS EXAMPLE 2

Synthesis of acid precursor (8) (using sodium hydride):

Synthesis of 2-methoxy-1-naphthaldehyde

Five hundred milliliters of a dimethylformamide solution of 103.2 g (0.6 mole) of 2-hydroxy-1-naphthaldehyde and 107.6 g (0.78 mole) of anhydrous potassium carbonate was stirred at 50° C. To the solution was added dropwise 145 g (0.78 mole) of methyl p-toluenesulfonate. After the addition, the mixture was stirred at 60° C. for 2 hours. The reaction mixture was added to 1.5 liters of water, and the precipitated crystals were collected by filtration. The crude crystals were recrystallized from a mixture of n-hexane and ethyl acetate (5/1) to give 93.8 g (0.504 mole) of 2-methoxy-1-naphthaldehyde.

Synthesis of 2-methoxy-1-naphthalodoxime

To 400 ml of ethanol and 180 ml of water were added 80 g (0.43 mole) of 2-methoxy-1-naphthaldehyde, 66 g (0.81 mole) of sodium acetate and 35.5 g (0.51 mole) of hydroxylamine hydrochloride, and the mixture was heated at reflux for 2 hours. After the reaction, the reaction mixture was added to 1 liter of water. The precipitated crystals were collected by filtration to give 85 g (0.42 mole) of 2-methoxy-1-naphthaldoxime.

Synthesis of acid precursor (8)

A sodium salt of aldoxime was prepared in the same way as in Synthesis Example 1 from 70.3 g (0.35 mole) of 2-methoxy-1-naphthaldoxime, 14 g (0.35 mole) of 60% oily sodium hydride and 750 ml of acetonitrile. The acetonitrile solution was cooled to 10° C., and while maintaining this temperature, 52 g (0.37 mole) of benzoyl chloride was added dropwise. After the addition, the mixture was stirred at room temperature for 1 hour. The reaction mixture was added to 2.5 liters of water, and the precipitated crystals were collected by filtration. The crude crystals were recrystallized from ethyl acetate to give 88 g (0.29 mole) of acid precursor (8) having a melting point of 127° C. to 128° C.

SYNTHESIS EXAMPLE 3

Synthesis of acid precursor (8) using sodium methylate:

96.4 g (0.5 mole) of a 28% methanol solution of sodium methylate was added to 300 ml of a methanol solution of 101.5 g (0.5 mole) of 2-methoxy-1-naphthaldoxime, and the uniform solution obtained was concentrated under reduced pressure to about 200 ml. Toluene (1 liter) was added to the concentrate, and the solution was stirred while cooling in an ice bath. The precipitated crystals were collected by filtration, and washed with toluene to give 112 g of a sodium salt of oxime.

1.1 liters of an acetonitrile solution of the resulting sodium salt was stirred at 0° C. to 5° C., and while maintaining this temperature, 70 g (0.5 mole) of benzoyl chloride was added dropwise. After the addition, the mixture was stirred at room temperature for 1 hour. The reaction mixture was poured into ice water, and the precipitated crystals were collected by filtration. The crude crystals were recrystallized from ethyl acetate to give 99.6 g (0.33 mole) of acid precursor (8) having a melting point of 127° C. to 128° C.

SYNTHESIS EXAMPLE 4

Synthesis of acid precursor (29):

To 200 ml of an acetonitrile solution of 20.1 g (0.1 mole) of 2-methoxy-1-naphthaldoxime were added 4.8 g (0.1 mole) of 50% oily sodium hydride and then 18 g (0.1 mole) of p-chlorobenzoyl chloride in the same way as in Synthesis Example 1. After the addition, the reaction mixture was added to water. The resulting crude crystals were recrystallized from a mixture of n-hexane and ethyl acetate (1/1) to give 20.9 g (0.062 mole) of acid precursor (29) having a melting point of 128.5° C. to 130° C.

SYNTHESIS EXAMPLE 5

Synthesis of acid precursor (21):

To 300 ml of an acetonitrile solution of 32.2 g (0.16 mole) of 2-methoxy-1-naphthaldoxime were added 7.7 g (0.16 mole) of 50% oily sodium hydride and then 16.2 g (0.08 mole) of terephthaloyl chloride in the same way as in Synthesis Example 1. After the addition, the reaction mixture was added to water. The resulting crude crystals were recrystallized from a mixture of dimethylformamide and ethyl acetate (5/1) to give 18 g (0.034 mole) of an acid precursor (21) having a melting point of 152° C. to 153° C.

SYNTHESIS EXAMPLE 6

Synthesis of acid precursor (50):

Synthesis of 2,4,6-trimethylbenzaldehyde

A benzene solution of 180 g (1.5 moles) of mesitylene, 90 g of aluminum chloride and 13 g of nickel dichloride was stirred at 70° C. to 80° C. Simultaneously, 125 ml of formic acid was added dropwise to 230 ml of chlorosulfonic acid to generate carbon monoxide and hydrogen chloride gas which were blown into the above benzene solution for 6 hours. Next, water and ethyl acetate were added to the solution which was separated into an organic and an aqueous layer. The organic layer was washed with an aqueous solution of sodium chloride, dried over magnesium sulfate, and concentrated under reduced pressure. The residue was purified by silica gel column chromatography (eluent: n-hexane/ethyl acetate=8/1) to give 34.5 g (0.233 mole) of 2,4,6-trimethylbenzaldehyde as a colorless oil.

Synthesis of 2,4,6-trimethylbenzaldoxime

To 120 ml of ethanol and 60 ml of water were added 29.6 g (0.2 mole) of 2,4,6-trimethylbenzaldehyde, 32.8 g (0.4 mole) of sodium acetate and 20.7 g (0.3 mole) of hydroxylamine hydrochloride, and the mixture was heated under reflux for 2 hours. After the reaction, the reaction mixture was added to 500 ml of water. The precipitated crystals were collected by filtration to give 28 g (0.17 mole) of 2,4,6-trimethylbenzaldoxime.

Synthesis of acid precursor (50)

To 150 ml of an acetonitrile solution of 13.8 g (0.0847 mole) of 2,4,6-trimethylbenzaldoxime were added 3.4 g (0.085 mole) of 60% oily sodium hydride and then 12.6 g (0.09 mole) of benzoyl chloride in the same way as in Synthesis Example 1. After the addition, water was added to the reaction mixture. The precipitate was extracted with ethyl acetate, washed with an aqueous solution of sodium chloride and dried over magnesium sulfate. The dried product was concentrated under reduced pressure, and the residue was recrystallized from a mixture of n-hexane and ethyl acetate (½) to give 9.0 g (0.036 mole) of acid precursor (50) having a melting point of 112° C. to 114° C.

The acid precursor of this invention can be used in various heat-developable image-forming materials. For example, heat-developable silver halide photogrpahic materials are described in *Shashin-Kogaku no Kiso,* pages 553–555 (a Japanese-language publication published by Corona Co., Ltd. in 1979), *Eizo Joho,* page 40 (April 1978), *Nebletts Handbook of Photography and Reprography,* pages 32–33 (7th Ed. Van Nostrand Reinhold Company), U.S. Pat. Nos. 3,152,904, 3,301,678, 3,392,020, 3,457,075, 3,531,286, 3,761,270, 3,985,565, 4,021,240, 4,022,617 and 4,235,957, British Pat. Nos. 1,131,108 and 1,167,777, Belgian Pat. No. 802,519, *Research Disclosure* (May 1978), pages 54–58 (RD-16966), *Research Disclosure* (June 1978), pages 9 to 15 (RD-17029), *Research Disclosure* (April 1976), pages 30–32 (RD-14453), and *Research Disclosure* (December 1976), pages 14–15 (RD-15227).

In the heat-development method using silver halide, a photographic material is used which comprises a support and a light-sensitive layer containing (1) a photosensitive silver halide emulsion, (2) a composition capable of generating a base by heating and (3) a developing agent for silver halide. When such a photographic material is exposed imagewise and then heated, the developing agent is activated by the action of the base, whereby the exposed silver halide is reduced to form a silver image.

The compound of this invention can be used for the purpose of stopping development of these heat-developable silver halide photographic materials and in similar developing methods.

The acid precursors of this invention can generate acids efficiently while they are present in a substantially dry film. Accordingly, the acid precursors of this invention is advantageously used to induce a chemical change by the acid generated upon heating.

The amount of the acid precursor used in this invention varies depending upon the specific precursor and the system in which it is used, but is generally not more than about 50% by weight, preferably not more than about 30% by weight, based on the weight of the coated film. The acid precursors of this invention can be used either singly or in combination with each other or with acid precursors other than those of the present invention.

The acid precursor of this invention can be included in a binder (such as gelatin) by dissolving it in a water-soluble organic solvent (such as methanol, ethanol, acetone or dimethylformamide) or a mixture of the organic solvent and water.

The acid precursor of this invention can also be included in the form of fine particles suspended in a binder (such as gelatin).

The following Examples illustrate the present invention more specifically. It should be understood, however that the scope of the present invention is not limited to these examples. Unless otherwise indicated, all percents, parts and ratios are by weight.

EXAMPLE 1

Speed of decomposition of the acid precursor in a solution:

A dimethylacetamide solution of the acid precursors shown below in a concentration of $2.5\times10^{-3}$ mole/liter was immersed in a constant-temperature vessel kept at 100° C., and the amount of the remaining precursor was measured at predetermined intervals by liquid chromatography (column: μ:Bondapak C-18; eluent: acetonitrile/water=2/1; internal reference: $7.5\times10^{-3}$ mole/liter of 1,4-dimethoxynaphthalene). A good linear relation was obtained in a primary reaction. Examples of the reaction rate constant are shown below.

| Acid precursor | $k(hr^{-1})$ | $T_{\frac{1}{2}}$ (hr) |
|---|---|---|
| (2) | $3.3\times10^{-2}$ | 21 |
| (7) | $1.65\times10^{-2}$ | 4.2 |
| (8) | 2.01 | 0.34 |
| (14) | $2.51\times10^{-1}$ | 2.8 |

EXAMPLE 2

Analysis of the heat-decomposition product of the acid precursor:

Acid precursor (8) was thermally decomposed under the same conditions as in Example 1, and the resulting benzoic acid and 2-methoxy-1-naphthonitrile (melting point 94.5° C.–95.5° C. from a separately prepared sample) were quantitatively determined by liquid chromatography. At the end of 4 hours after the start of the reaction, the acid precursor (8) disappeared. It was seen from a separately prepared calibration curve that acid precursor (8) reacted to quantitatively produce benzoic acid and 2-methoxy-1-naphthonitrile. The rate of formation of 2-methoxy-1-naphthonitrile at this time showed a good linear relation in a primary reaction, and the rate constant was $3.36\times10^{-2}$ $min^{-1}$. This rate constant value coincided with the rate constant of disappearance of acid precursor (8), i.e., $3.34\times10^{-2}$ $min^{-1}$ (2.01 $hr^{-1}$), which is shown in the Example 1.

The above fact shows that when heated, acid precursor (8) quantitatively releases benzoic acid.

EXAMPLE 3

Example of application to a heat-developable photographic material:

Preparation of a silver iodobromide emulsion

Gelatin (40 g) and 26 g of potassium bromide were dissolved in 3000 ml of water. The solution was maintained at 50° C. and stirred. Then, a solution of 34 g of silver nitrate in 200 ml of water was added to the resulting solution over the course of 10 minutes.

Thereafter, a solution of 3.3 g of potassium iodide in 100 ml of water was added over 2 minutes.

The pH of the resulting silver iodobromide emulsion solution was adjusted to precipitate it, and the excess of the salt was removed. Then, the pH was adjusted to 6.0, and 400 g of the silver iodobromide emulsion was obtained.

Preparation of a dispersion of a coupler in gelatin

| | |
|---|---|
| (a) Compound of the following formula | 10 g |

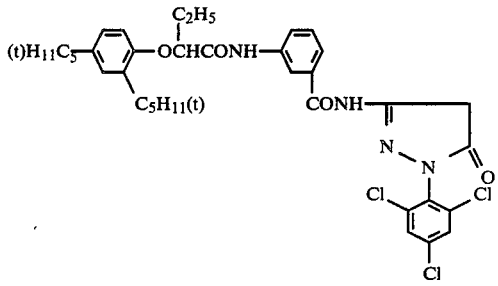

| | |
|---|---|
| (b) 2-Ethyl-Hexyl Succinate Sodium Sulfonate | 0.5 g |
| (c) Tricresyl Phosphate (TCP) | 2.5 g |

The ingredients were weighed, and 30 ml of ethyl acetate was added to dissolve them.

The resulting solution was mixed with 100 g of a 10% gelatin solution with stirring, and the mixture was dispersed by a homogenizer at 10,000 rpm for 10 minutes.

Preparation of a dispersion of an acid precursor in gelatin

Water (90 g) and 10 g of gelatin (as a 10% aqueous solution) were added to 10 g of the acid precursor (8), and the mixture was pulverized in a mill containing 100 g of glass beads with an average diameter of about 0.6 mm at 3,000 rpm for 10 minutes. The glass beads were separated by filtration, and an aqueous dispersion of acid precursor (8) was obtained.

Production of a photographic material

A coating agent of the following composition was coated on a polyethylene terephthalate support to a wet film thickness of 65 microns, and dried to form a photographic material A.

| | |
|---|---|
| (a) Silver Iodobromide Emulsion | 10 g |
| (b) Gelatin Dispersion of the Coupler | 3.5 g |
| (c) Solution of 0.22 g of Guanidine Tri-chloroacetate in 2.2 ml of Water | |
| (d) Gelatin (10% Aqueous Solution) | 5 g |
| (e) Solution of 0.2 g of 2,6-Dichloro-p-Aminophenol in 15 ml of Water | |
| (f) Aqueous Dispersion of Acid Precursor (8) of the Invention | 1.5 ml |

A photographic material B was prepared by the same procedure as above except that 1.5 ml of water was used instead of the aqueous dispersion (f) of the precursor (8).

Testing of the photographic materials

Each of the photographic materials was exposed imagewise for 5 minutes at 2000 luxes using a tungsten-filament lamp, and then heated uniformly on a heat block heated to 150° C. for 20 seconds and 40 seconds respectively. A negative image of magenta color was obtained in each run. The density of the image was measured by a Macbeth transmission densitometer (TD-504) using green light. The results are tabulated below.

| | Heated at 150° C. for 20 seconds | | Heated at 150° C. for 40 seconds | |
|---|---|---|---|---|
| Sample No. | Maximum density | Minimum density | Maximum density | Minimum density |
| A (invention) | 1.95 | 0.08 | 2.02 | 0.12 |
| B (comparison) | 2.05 | 0.26 | 2.10 | 0.54 |

The above results show that when the acid precursor of this invention is used, the increase of the maximum and minimum densities is small even if the developing time is doubled. On the other hand, the comparative photographic material containing no acid precursor gave an image with marked fogging. The acid precursor of this invention is thus demonstrated to have a high effect of stopping development.

While the invention has been described in detail and with reference to specific embodiments thereof, it will be apparent to one skilled in the art that various changes and modifications can be made therein without departing from the spirit and scope thereof.

What is claimed is:

1. A heat-developable silver halide photographic light-sensitive material comprising a support having thereon at least one light-sensitive layer comprising (1) a photosensitive silver halide emulsion, (2) a composition capable of generating a base upon heating, (3) a developing agent for silver halide, and (4) an organic acid precursor represented by the following general formula (A) capable of stopping the development of the heat-developable silver halide photographic light-sensitive material:

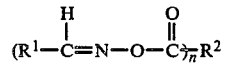

(A)

wherein $R^1$ is selected from the group consisting of alkyl, substituted alkyl, cycloalkyl, aralkyl, alkenyl, aryl, substittued aryl and heterocyclic groups; $R^2$ is a mono-, di- or tri-valent group selected from the group consisting of alkyl, substituted alkyl, cycloalkyl, aralkyl, aryl, substituted aryl and heterocyclic groups and wherein the carbonyl and —CH= moieties of the group or groups represented by the formula (I):

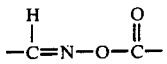

(I)

are bound to carbon atoms of the groups represented by $R^1$ and $R^2$; and n is an integer of 1, 2 or 3.

2. A method of forming a photographic image which comprises imagewise exposing a heat-developable silver halide light-sensitive material as claimed in claim 1, and developing said material by exposing it to heat, wherein the acid precursor represented by formula (I) stops development of the heat-sensitive material.

3. A heat-developable silver halide light-sensitive material as claimed in claim 5, wherein $R^1$ and $R^2$ are selected from the group consisting of straight chain or branched chain alkyl having 1 to 18 carbon atoms, 5- or 6-membered cycloalkyl having 5 to 10 carbon atoms, benzyl, β-phenethyl, vinyl, allyl, crotyl, substituted or unsubstituted styryl, aryl having 6 to 18 carbon atoms, pyridyl, furyl, thienyl, pyrrole and indolyl groups.

4. A heat-developable silver halide light-sensitive material as claimed in claim 3, wherein $R^1$ and $R^2$ are selected from the group consisting of phenyl, substituted phenyl, naphthyl, and substituted naphtyl, wherein said substituents are selected from the group consisting of substituted or unsubstituted alkyl, substituted or unsubstituted alkoxy, substituted or unsubstituted aryl, halogen, disubstituted amino, acylamino, sulfonylamino, cyano, nitro, alkyl-thio aryl-thio, alkyl-sulfonyl, aryl-sulfonyl, oxycarbonyl, carbonyloxy, substituted or unsubstituted carbamoyl, and substituted or unsubstituted sulfamoyl groups.

5. A process as claimed in claim 2, wherein $R^1$ and $R^2$ are selected from the group consisting of straight chain or branched chain alkyl having 1 to 18 carbon atoms, 5- or 6-membered cycloalkyl having 1 to 18 carbon atoms 5- or 6-membered cycloalkyl having 5 to 10 carbon atoms, benzyl, β-phenethyl, vinyl, allyl, crotyl, substituted or unsubstituted styryl, aryl having 6 to 18 carbon atoms, pyridyl, furyl, thienyl, pyrrole and indolyl groups.

6. A process as claimed in claim 5, wherein $R^1$ and $R^2$ are selected from the group consisting of phenyl, substituted phenyl, napthyl, and substituted naptyl, wherein said substituents are selected from the group consisting of substituted or unsubstituted alkyl, substituted or unsubstituted alkoxy, substituted or unsubstituted aryl, halogen, disubstituted amino, acylamino, sulfonylamino, cyano, nitro, alkyl-thio aryl-thio, alkyl-sulfonyl, aryl-sulfonyl, oxycarbonyl, carbonyloxy, substituted or unsubstituted carbamoyl, and substituted or unsubstituted sulfamoyl groups.

7. A heat-developable silver halide photographic light-sensitive material as claimed in claim 1, wherein the acid precursor represented by formula (A) is contained in an amount not more than 50% by weight based on the weight of the coated photographic material.

8. A process as claimed in claim 2, wherein the acid precursor represented by formula (A) is contained in an amount not more than 50% by weight based on the weight of the coated photographic material.

9. A heat-developable silver halide photographic light-sensitive material as claimed in claim 1, wherein the acid precursor represented by formula (A) is contained in an amount not more than 30% by weight based on the weight of the coated photographic material.

10. A process as claimed in claim 2, wherein the acid precursor represented by formula (A) is contained in an amount not more than 30% by weight based on the weight of the coated photographic material.

* * * * *